United States Patent [19]

Weber

[11] 4,007,752

[45] Feb. 15, 1977

[54] TELESCOPIC UMBRELLA

[75] Inventor: Heinz Weber, Hilden, Germany

[73] Assignee: Telesco Brophey Limited, Montreal, Canada

[22] Filed: May 8, 1975

[21] Appl. No.: 575,748

[30] Foreign Application Priority Data

May 8, 1974 Germany ..... 2422209

[52] U.S. Cl. ..... 135/25 R; 135/27; 135/29

[51] Int. Cl.[2] ..... A45B 19/04; A45B 19/10

[58] Field of Search ..... 135/25, 27

[56] References Cited

UNITED STATES PATENTS

| | | | |
|---|---|---|---|
| 1,797,993 | 3/1931 | Michaud | 135/27 |
| 1,824,192 | 9/1931 | Bouma | 135/27 |
| 2,649,103 | 8/1953 | Militano | 135/25 R |
| 3,467,115 | 9/1969 | Brooks et al. | 135/25 R |
| 3,746,024 | 7/1973 | Kida | 135/25 R X |
| 3,818,919 | 6/1974 | Schuttes et al. | 135/25 R |
| 3,893,467 | 7/1975 | Wingen | 135/25 R |
| 3,902,514 | 9/1975 | Weber | 135/27 X |

FOREIGN PATENTS OR APPLICATIONS

| | | | |
|---|---|---|---|
| 717,989 | 10/1931 | France | 135/25 R |
| 2,320,496 | 4/1973 | Germany | 135/25 R |
| 2,153,313 | 10/1971 | Germany | 135/25 R |

*Primary Examiner*—Werner H. Schroeder
*Assistant Examiner*—Conrad L. Berman
*Attorney, Agent, or Firm*—Alan Swabey & Co.

[57] ABSTRACT

A telescopic umbrella is provided; the umbrella has a telescoping umbrella stick, with a runner sliding thereon with stretchers running from the slide; at the outer ends of the stretchers are dome ribs, above each of which is located an auxiliary link running approximately parallel therewith, one end of each auxiliary link being hinged to a dome rib while the other end is hinged to a strut; the strut running, when the umbrella is in an open configuration, obliquely upwards from the stretcher towards the umbrella stick, and a control link running from each stretcher approximately parallel with an inner dome rib part, the outer end of the control link serving to control the folding motion of the outer dome rib part in dependence on the movement of the umbrella runner.

2 Claims, 5 Drawing Figures

7
10
20
8b
II
12
9
19
22
23
1
18
21
14
16
17
15
13
33
31
24
25
27
26
8c
11
2
5
3

E
8c
K
24
26
29
22''
A
II
8
8b
22
a
L
22'''
12
11
9
19
10
23
S
I
20
18
21
14
16
17
15
31
13
7
32
1
z
z
30
29'
28
27
22'
25
α
22''
8b
22

TELESCOPIC UMBRELLA

BACKGROUND OF THE INVENTION

1. Field of the Invention

The invention relates to a shortenable umbrella of the folding type.

2. Description of the Prior Art

Positive control of the peripheral dome rib parts, effected in conjunction with the closing and opening movements of a shortenable umbrella, is disclosed, for example, in French Pat. No. 717,989 and in U.S. Pat. Nos. 2,616,439 and 2,649,103.

In the case of designs of this type in French Application No. 7,216,899 and German Disclosure Text No. 2,320,496, inward and outward folding of the outer dome rib part is achieved by means of a control rod. One end of this control rod is connected to the slide strut of the dome rib, while the other end is connected to a carriage running on the central dome rib. The central dome rib is also connected to a transfer member which causes the outer dome rib part to fold outwardly or inwardly. According to one embodiment, this transfer member is in the form of a toothed rack, which cooperates with the corresponding externally toothed eye of this outer dome rib part. According to a variant, a curved member is interposed between the central and outer dome ribs, the curved member engaging with a hinge pin located away from the eye. The carriage on the central dome rib is spring loaded in the sense of opening the dome, but this makes it more difficult to close the umbrella frame. This design is, moreover, relatively complex, and this has a considerable effect upon the manufacturing costs and durability of an umbrella of this kind.

SUMMARY OF THE INVENTION

It is an object of the invention to provide an umbrella of the type mentioned above, which is simpler to produce and to handle, and in which the component effecting the folding movement is also used as a means of stabilizing the dome, so that when the umbrella is open, additional stiffening of the dome is achieved.

This purpose is achieved by a shortenable umbrella, having an umbrella stick, with a runner slidable thereon from which runner stretchers are pivoted, at the ends of which are seated dome ribs, and above each of which is located an auxiliary link running approximately parallel therewith, one end of each auxiliary link being hinged to a dome rib while the other end is hinged to a strut, said strut running, when the umbrella is in an open configuration, obliquely upwards from said slide strut towards the umbrella stick, and a control strut running from each stretcher approximately parallel with an inner dome rib part, the outer end of said control link and serving to control the folding motion of the outer dome rib part in dependence on the movement of the umbrella runner.

The configuration provided by the invention results in a shortenable umbrella of the type described above which is easy to handle an is stable. It provides considerable head freedom and stable support for the dome. In the folded condition, its overall length is considerably shorter, and reliable positive control of the outer dome rib parts is achieved with simple means. The means used to effect this positive control also provide additional stability for the dome when the umbrella is open. The transfer means for the folding motion is a control link running approximately parallel with the inner dome rib part, one end of the link being attached to the stretcher, while the other end engages directly with an arm of this outer dome rib part projecting over the folding hinge location of the outer dome rib section. In this way, the varying angular setting of the slide strut, produced by the movement of the runner, is used in an advantageous manner to produce a positive folding motion of the outer dome rib part.

In conjunction with the central dome rib part, on the one hand, and parts of the outer dome rib section and the slide strut, on the other hand, the control strut forms a linkage parallelogram. When the umbrella is in the folded position, the control strut assumes a position almost in contact with the inner dome rib part, thus saving space. Although the control link is rigid enough to be used as a push rod, it is also resilient and capable of bending and assuming a substantially curved shape in the event of a gust of wind acting upon the top of the dome. On the other hand, the stabilizing parallel position of the control link and the central dome rib part also prevents the umbrella from being blown inside out by a gust of wind from underneath.

The construction which permits freedom of movement in the direction of folding provides for the hinge location between the control strut and the outer dome rib section, and also provides advantageous lateral stabilization at the shoe-like end of the arm on the outer dome rib part, since this shoe, in spite of the locking action of the bearing eye in the control link, clamps itself around the outer dome rib part precisely when the umbrella dome is open. This also ensures as much coincidence as possible between the outer and central dome rib parts in the extended position when the dome is open.

The U-shaped section of the shoe encloses the hinge of the central dome rib part, while the legs of the shoe do not increase the cross-section of the umbrella frame when the latter is in the folded condition.

Freedom of movement is obtained advantageously by means of a longitudinal slot in the legs of the shoe. When the umbrella is being opened, this same longitudinal slot produces so much hinge play in the plane of folding that the outer dome rib parts assume, by their own weight, an outward preliminary folding position, as a result of which the linkage parallelogram also assumes a favourable opening position in relation to the slide strut. This reliably defines the extended position of the dome rib when the dome is open, since the end of the control strut, in that position, comes to a stop against the central dome rib part entering the hinge shoe. The tensile forces from the covering material acting upon the ends of the dome ribs, i.e., on the outer folding parts thereof, cannot lift these dome rib parts into a position which makes the dome of the umbrella unstable. It is thus very easy to open the dome of the umbrella. Moreover, the natural curvature of the dome ribs, especially that of the central parts thereof, also spares the covering material. This curvature fortunately occurs mainly in the vicinity of the inner dome rib parts. If the control link running under the central dome rib part, constituting the transfer means for the folding motion, and running substantially parallel with the central dome rib part, is made shorter than the distance between the hinge points on the inner dome rib part, the curvature of the inner dome rib part occurs early in the opening phase of the dome, namely, before the covering material can become a definite factor in forming the curve in each dome rib. The curvature of the dome is brought about very largely by the support system itself.

By using the varying angular setting of the stretcher in relation to the umbrella stick, the control link is loaded in tension and the inner dome rib part in compression. This dome rib part forms an "arc", of which the control link is the "chord". The fact that the slot providing freedom for the folding motion of the outer dome rib part is at an acute angle to the central dome rib part, and is of a length corresponding approximately to the difference between the distance A between the two hinge points on the central dome rib part and the length L of the control link, provides very smooth positive control, in spite of the closeness of the control link and inner dome rib part (which also assists in providing the desired freedom of head movement in the dome of the umbrella).

Attention is also paid to the desirability of having the umbrella fold as compactly as possible, in that the acute-angled slotted hinge between the control link and the outer dome rib part makes it possible for the outer dome rib part to assume a position largely in direct contact with the inner dome rib part. If, in addition to this, a sewing eye for the covering material is provided beyond the hinge point between the inner dome rib part and the outer dome rib part, this allows the covering material to arrange itself neatly, thus facilitating the folding of the umbrella frame.

Other advantages and details of the object of the invention are explained hereinafter in greater detail with the aid of the embodiment illustrated in the accompanying drawings.

DESCRIPTION OF THE PREFERRED EMBODIMENTS

Figure 1:
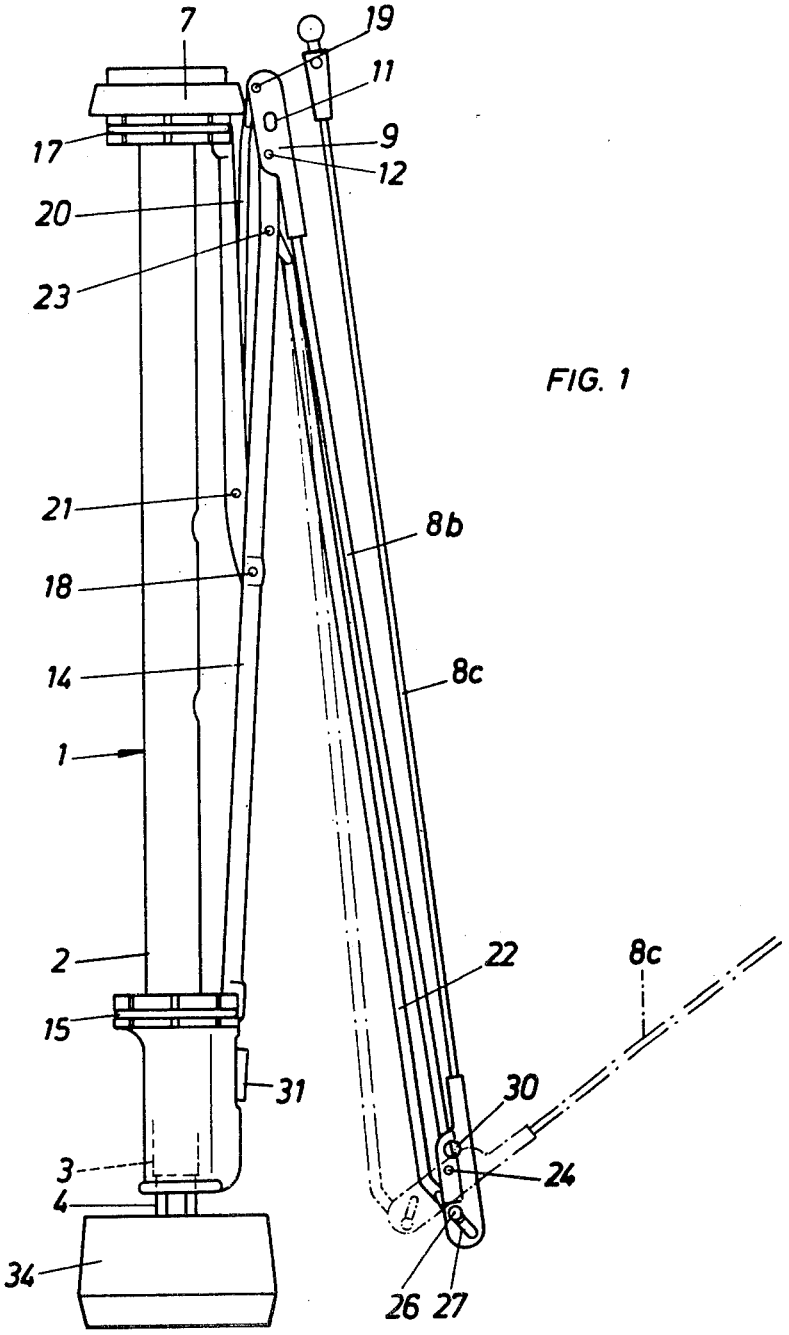
FIG. 1 shows the umbrella according to the invention in the shortened condition but with the bundle of dome ribs not completely folded together, for the sake of clarity.

With reference to the drawings, an umbrella has a stick 1 consisting of three telescoping tubular parts 2, 3 and 4, secured in the extended positions by catches 5 in the usual manner. Tubular part 2 is of the largest and tubular part 4 is of the smallest, diameter. Tubular parts 3 and 4 are of hexagonal cross-section, tubular part 2 is of circular cross-section, drawn down, for a short distance, to the external profile of central tubular part 3.

Located at the top of umbrella stick 1 is a crown 7 of the umbrella. Dome ribs 8 are directed towards the crown in uniform angular distribution, each of the said ribs consisting of an inner part **8*b* and a folding outer part 8*c* attached thereto. The inner end of part 8*b* terminates in a cross-sectionally U-shaped fitting 9. The gap between this fitting 9 and the crown is bridged only by umbrella covering material 10, which is secured to the umbrella crown in the usual manner. The covering material 10 is also attached to fitting 9, which is provided with a sewing eye 11 for the purpose. Covering material 10** is also secured at folding joint K and, finally, at the free end E of the dome rib.

A stretcher 14, extending from umbrella runner 13, is connected to hinge point 12 in fitting 9 on inner dome rib part **8*b*, as a part of support system S carrying and controlling dome ribs 8. Stretchers 14 are hinged to the umbrella runner 13 by means of the usual tie-wire 15**.

Runner 13 slides on umbrella stick 1.

A strut 16 runs from crown 7 to which it is hinged by the usual tie-wire 17. Strut 16 is also hinged at 18 to stretcher 14, the said hinge point lying about half-way along stretcher 14. When the umbrella is open, auxiliary strut 16 runs obliquely upwards to crown 7.

An auxiliary link 20 runs, from a second hinge point 19 on fitting 9, above stretcher 14, i.e., in a free space which exists in any case. Link 20 is connected to auxiliary strut 16 at hinge point 21, the distance between hinge points 21 and 18 corresponding to the distance between hinge points 12 and 19. The ends of link 20 may be flattened and provided with bearing holes.

Auxiliary link 20 and a portion of stretcher 14 constitute the longer link, while fitting 9 and a portion of auxiliary strut 16 constitute the shorter link, of a linkage parallelogram I which stabilizes the dome of the umbrella and controls the movement thereof in dependence upon the movement of the umbrella runner 13.

Outer dome rib part **8*c* is also positively controlled in relation to the displacement of slide 13 on umbrella stick 1, to which end a control link 22 is connected to stretcher 14 running from slide 13**.

When the dome of the umbrella is not yet fully open, control link 22 runs approximately parallel with the inner dome rib part **8*b* (FIG. 4), and thereunder, and being connected to stretcher 14 at hinge point 23. The other end of link 22 is connected, by means of a hinge 26, to an arm 25, on outer dome rib part 8*c*, extending beyond the folding hinge formed by hinge point 24. Control link 22 and inner dome rib part 8*b* constitute the longer link of a hinged parallelogram II, whereas arm 25 and a portion of stretcher 14** constitute the shorter link of this hinged parallelogram.

Figures 4, 5:
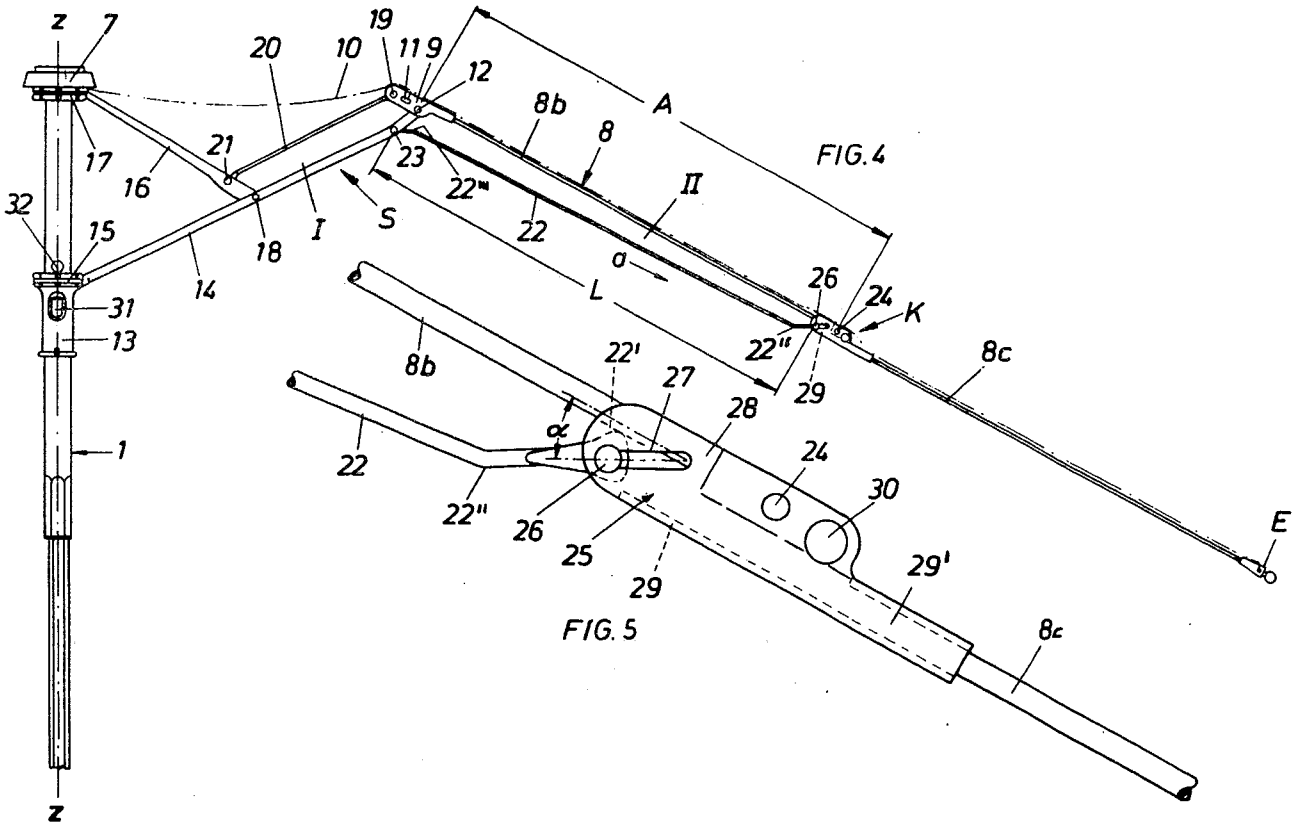
FIG. 4 shows the umbrella partly open — or partly closed — with the covering material still slack.
FIG. 5 shows, to an enlarged scale, the hinge area between the outer dome rib part and the inner dome rib part.

Control strut 22 is shorter than the distance A between hinge points 12 and 24 on inner dome rib part **8*b* (in the extended position). The result of this is that foldable outer dome rib part 8*c*, even in the extended position, is drawn towards inner dome rib part 8*b* before the covering material starts to apply tension at free end E of foldable dome rib part 8*c*** (FIG. 4).

Hinge connection 26, 27 between control link 22 and inner dome rib part **8*c* provides freedom of movement, in the direction of folding, in excess of the usual play in a hinge. As may be seen in FIG. 5, this freedom of movement is provided by a slotted guide 27 for strut 22. Slotted guide 27, running at an acute angle alpha to dome rib part 8*c*, is located in one leg 28 of arm 25** which is a cross-sectionally U-shaped component.

A web 29 in cross-sectionally U-shaped arm 25 is cut back slightly, in the vicinity of slotted guide 27, in order to permit free entry of the flattened end of control strut 22. This U-shaped configuration of arm 25 contributes to the stabilization of this joint area and provides stabilizing lateral support to the parts connected to each other, when the said parts are in the extended position. Leg 28 of arm 25 also forms, in practice, a kind of hinge shoe over the entire distance between hinge points 24 and 26. The remainder of the length of leg 28 is rolled into a bush 29 which accommodates outer dome rib part 8*c* and is securely attached thereto.

Located between bush 29 and hinge pin 24 in leg 28 is a sewing eye 30 for the attachment of covering material 10.

As may be seen in FIG. 5, when outer dome rib part 8*c* is extended, end 22'' of control strut 22 comes to a stop against dome rib part 8*b* carried in arm 25. At 22'', the said strut is bent slightly, so that, when the umbrella frame is in the folded condition, there is enough room for the pin of hinge 24 to enter.

The other end of control strut 22 is also designed with the folding requirements in view. The flattened end of the strut 22, comprising a bearing eye for the pin of hinge point 23, is secured between the legs of U-shaped control strut 14. The bend 22''' provided near this end of strut 22 points in the opposite direction to bend 22''.

Auxiliary strut 16 is also made out of U-shaped material. Since the U is open upwardly, this profile, as may be seen in FIG. 1, accommodates one end of auxiliary link 20 when the umbrella is in the folded position.

Runner 13 is provided with a locking pawl fitted with a push-button 31; the pawl engages a slide-opening catch 32 in umbrella stick 1 when the umbrella is fully open. An imtermediate catch 33 is located ahead of the runner-opening catch 32, for use when the umbrella is left to dry out with the dome in the open position.

Figures 2, 3:
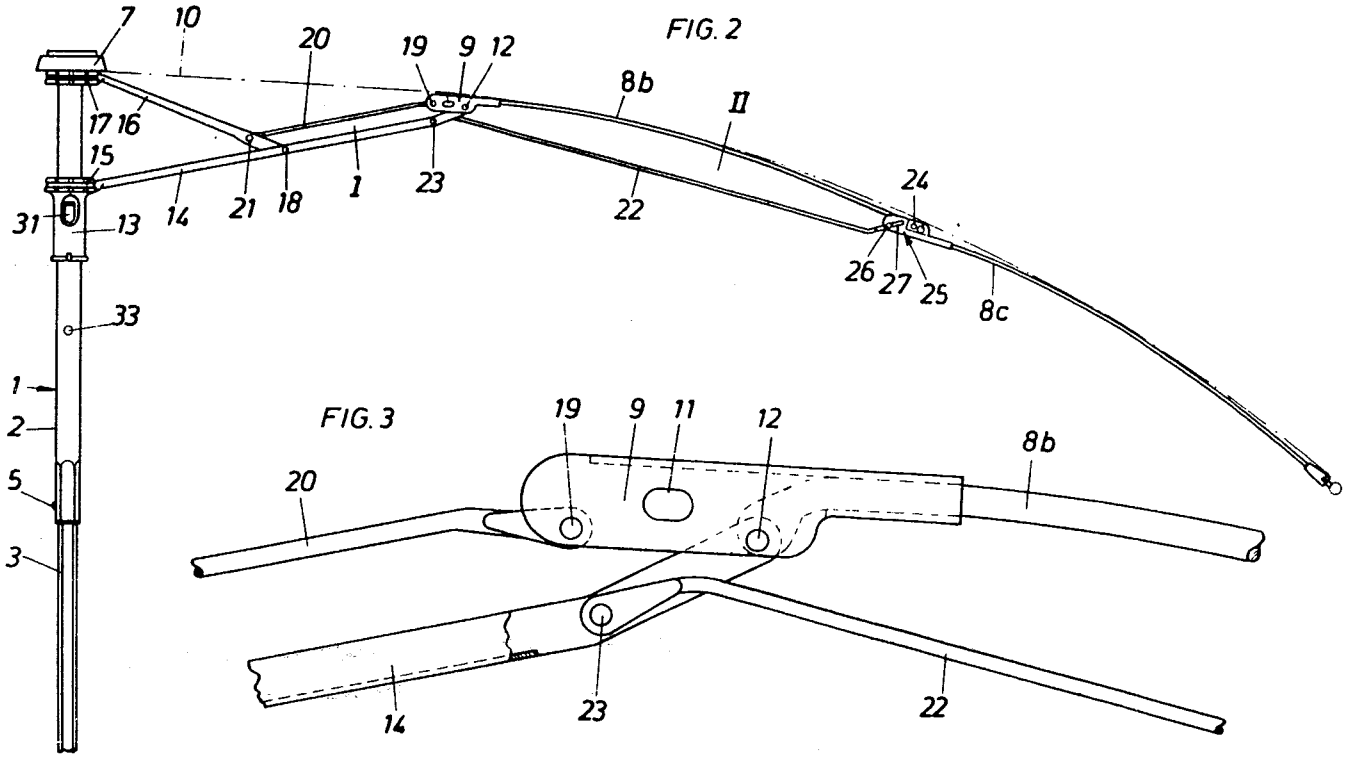
FIG. 2 is a partial representation of the umbrella in the open position.
FIG. 3 shows, to an enlarged scale, the hinge area between the central dome rib part and the support system.

If the umbrella is to be closed from the position shown in FIG. 2, push-button 31 is operated to allow slide 13 to be moved towards umbrella handle 34. This causes the angle between slide strut 14 and the axis *z* — *z* of the umbrella to decrease constantly, until the strut 14 lies directly against the umbrella stick 1, while control strut 22 is pushed in the direction of arrow *d*. This causes arm 25 to pivot about hinge point 24 of dome rib part 8*b*, so that outer dome rib part 8*c* is folded positively onto inner dome rib part 8*b*. This particular position is not shown in the drawing, since it may be gathered from FIG. 1.

With the increasing approach of the entire support system S and dome-rib parts 8*b* and 8*c* towards axis *z* — *z* of the umbrella stick 1, which approach is brought about partly by moving the umbrella slide 13 and, in the final phase, to a certain extent, by grasping the whole bundle of dome ribs, shortening of umbrella stick 1 is carried out by the application of suitable pressure. A position thus arises in which umbrella slide 13 lies in front of umbrella handle 34, fitting 9 lies against crown 17, and arm 25 lies against umbrella handle 34 or enters thereinto.

In order to open the umbrella, umbrella stick 1 is first of all extended. At this time, freedom of movement 26, 27 between dome rib part 8*c* and control link 22 causes outer dome rib part 8*c*, assisted by covering material 10, to assume a position which assists in the opening of the umbrella, while hinged parallelogram II assumes an intermediate position which also assists in the opening of the umbrella.

Movement of runner 13 towards crown 7 causes control link 22 to fold the outer dome rib part positively outwards. In view of the hinge points of stretchers 14 and struts 16, and of the fact that fitting 9 rests against crown 7, thus keeping hinge point 18 outside the self-locking dead-center position, this movement takes place without any obstruction. Furthermore, bend 22''' in the control link 22 also provides a certain amount of assistance in the form of resilient spreading. Dome ribs 8 assume the intermediate position illustrated in FIG. 4, in which outer dome rib part 8*c* already assumes an extended position in relation to inner dome rib part 8*b*. In this position, the umbrella covering material still lies slackly on supporting dome ribs 8. Further upward movement of runner 13 causes stretcher 14, which is assuming an increasingly greater angle to umbrella stick axis *z* — *z*, to apply a restraining tension load to control link 22. This does not lead to a positively extended position of dome rib part 8*c*, but to an almost extended position of hinge points 23, 12, 24. This brings inner dome rib part 8*b* to the position of an "arc" shown in FIG. 2, the "chord" thereof being control link 22 which is not extensible. Thus the curvature of dome rib 8 is not entirely dependent upon the tension applied by the covering material.

Whereas, when the umbrella is open, control link 22 is permanently under tension, arched dome rib part 8*b* thereabove is under compression. Since the length of slot 27 is approximately equal to the difference between distance A and the length L of the control strut, a smoothly controllable hinged parallelogram II is available in the intermediate opening or closing phase of the umbrella.

The load applied by outer dome rib part 8*c* assists the pin of hinge point 26 to move to the outer end of slot 27, so that control link 22 moves far enough away from inner dome rib part 8*b*, thus increasing the effective leverage length of arm 25 (see position shown in dotted lines in FIG. 1). In the position shown in full lines in FIG. 1, the pin of hinge point 26 is at the opposite end of slot 27.

Bends 22'' and 22''' in control strut 22 make it possible to equalize the tension in linkage parellelogram I, so that greater tolerances at the hinge points can be compensated for.

I claim:

1. A collapsible umbrella having an umbrella stick, a crown at the end of the stick, a runner slidably mounted on the stick, stretcher members, each pivotally mounted at one end thereof to said runner, dome ribs pivotally connected to each stretcher member at free ends thereof, and each dome rib extending in a direction away from the crown, strut members, each hinged at one end to a support member on the stick at the other ends, each to a respective one stretcher member at a hinge point intermediate the ends of said stretcher member, each dome rib including an inner section and an outer section hinged to the outer end of the inner section, said inner section being spaced from said crown, said stretcher member being connected to the inner section thereof, a first control link member hinged to the strut at a point intermediate the ends of the strut member, said first control link hinged to an extension of the inner section of the dome rib inwardly of the hinge point with the stretcher member forming a parallelogram linkage with the stretcher member, the first control link member, the extension of the inner dome rib section and the portion of the strut member between the stretcher and the first control link; a second control link means hinged at one end to the stretcher member between the ends thereof and at the other end to an extension of the outer dome rib section extending inwardly of the hinge point with the inner dome rib section, whereby as the runner is moved on the stick to open and close the frame, the first and second control link means act in tension and compression respectively to urge the outer section to pivot about said hinge point at the outer end of the inner dome rib section.

2. An umbrella according to claim 1, wherein A > L where A is the length of the inner rib section between the hinge point with the stretcher and the hinge point with the outer section, and L is the length of the second control link means between the hinge point with the stretcher and its hinge point with the outer section, such that the inner section will bow convexly away from the second control link member.

* * * * *